US007637633B2

(12) United States Patent
Wong

(10) Patent No.: US 7,637,633 B2
(45) Date of Patent: Dec. 29, 2009

(54) HEAT DISSIPATION DEVICES FOR AN LED LAMP SET

(75) Inventor: Shwin-Chung Wong, Hsin-Chu (TW)

(73) Assignee: National Tsing Hua University, Hsin-chu (TW)

( * ) Notice: Subject to any disclaimer, the term of this patent is extended or adjusted under 35 U.S.C. 154(b) by 30 days.

(21) Appl. No.: 11/548,898

(22) Filed: Oct. 12, 2006

(65) Prior Publication Data

US 2007/0086196 A1 Apr. 19, 2007

(30) Foreign Application Priority Data

Oct. 18, 2005 (TW) ..... 94136258 A
Jan. 9, 2006 (TW) ..... 95100797 A

(51) Int. Cl.
*F21V 29/00* (2006.01)

(52) U.S. Cl. ..... 362/294; 362/547; 362/218; 362/373; 362/800

(58) Field of Classification Search ..... 362/97, 362/235, 294, 547, 362, 218, 373, 800; 165/104.33
See application file for complete search history.

(56) References Cited

U.S. PATENT DOCUMENTS 4,729,076 A * 3/1988 Masami et al. ..... 362/235
5,857,767 A * 1/1999 Hochstein ..... 362/294
6,472,823 B2 * 10/2002 Yen ..... 315/112
6,612,717 B2 * 9/2003 Yen ..... 362/245
6,799,864 B2 * 10/2004 Bohler et al. ..... 362/236
6,910,794 B2 * 6/2005 Rice ..... 362/547
6,917,143 B2 * 7/2005 Matsui et al. ..... 313/35
6,964,501 B2 * 11/2005 Ryan ..... 362/294
7,047,640 B2 * 5/2006 Lee et al. ..... 29/890.046
7,095,187 B2 * 8/2006 Young ..... 315/360
7,140,753 B2 * 11/2006 Wang et al. ..... 362/294
7,198,386 B2 * 4/2007 Zampini et al. ..... 362/294
7,204,615 B2 * 4/2007 Arik et al. ..... 362/294
7,237,936 B1 * 7/2007 Gibson ..... 362/547
7,270,446 B2 * 9/2007 Chang et al. ..... 362/294
7,278,761 B2 * 10/2007 Kuan ..... 362/294
7,309,145 B2 * 12/2007 Nagata et al. ..... 362/294
7,314,291 B2 * 1/2008 Tain et al. ..... 362/294
7,331,691 B2 * 2/2008 Livesay et al. ..... 362/294
7,345,320 B2 * 3/2008 Dahm ..... 257/99
2006/0072344 A1 * 4/2006 Kim et al. ..... 362/632
2006/0198161 A1 * 9/2006 Lin ..... 362/613
2008/0094850 A1 * 4/2008 Woodward ..... 362/507

* cited by examiner

*Primary Examiner*—Jong-Suk (James) Lee
*Assistant Examiner*—Leah S Lovell

(57) ABSTRACT

Heat dissipation devices for an LED lamp set has a plate-type heat spreader as the core unit. The plate-type heat spreader is either a flat-plate heat pipe or a metal plate embedded with heat pipes. The high-power LED lamps are thermally connected to the bottom surface of the heat spreader so that the heat generated by the LED lamps is absorbed by the evaporation region of the flat-plate heat pipe or the embedding heat pipes. The heat is spread by internal vapor motion of the working fluid toward different regions of the heat spreader. The top surface of the heat spreader is connected with a finned heat sink, where the heat is delivered to the ambient air. The hot air leaves by buoyancy through the openings on a lamp housing located above the finned heat sink. The inner surface of the lamp housing can be connected with the top surface of the plate-type heat spreader, with the heat dissipated out at the surface of the housing by natural convection.

5 Claims, 6 Drawing Sheets

HEAT DISSIPATION DEVICES FOR AN LED LAMP SET

RELATED APPLICATIONS

The present application is based on, and claims priority from, Taiwan Application Number 094136258 filed on Oct. 18, 2005 and Taiwan Application Number 095100797 filed on Jan. 9, 2006. The disclosures of which are hereby incorporated by reference herein in its entirety.

BACKGROUND OF THE INVENTION (1) Field of the Invention

This invention relates to heat dissipation of light-emitting diode (LED) lamps.

(2) Brief Description of Related Art

The high power LED light devices produce considerable amount of heat, which may cause performance degrade or even damage if the heat is not removed from the LED chips efficiently. In an LED light device, the core is an LED chip mounted on a substrate. A transparent top covering the LED chip serves as a lens for modifying the direction of the emitted light. Although there are many different designs, the major heat dissipation route for the heat produced by the LED chip usually is managed through the base substrate to which the LED chip is mounted or through an additional metal heat sink below the base substrate and then to the outer heat sink.

Traditional adoption of fans for active cooling system not only introduces noise problems but also brings risk of damage to a LED lamp if the fan is out of order. In contrast, passive cooling with natural convection is quiet, continuous and time-unlimited. But since a natural convection system is relatively weak for heat dissipation, to solve this problem, a large surface area is needed to enhance heat dissipation capacity. Most passive cooling devices for LED lamps adopt high-conductivity materials, such as copper or aluminum, with extended surfaces for heat dissipation. However, the thermal dissipation capacities of these pure metals may be still insufficient for dissipating the heat generated from the LED lamps which give a relatively high temperature during operation as a result. Therefore, highly conductive devices such as heat pipes or loop heat pipes have been applied in LED devices to replace the use of pure metal plates. U.S. Pat. No. 7,095,110 disclosed connecting LED chips with planar heat pipes to improve passive heat dissipation. However, additional heat dissipation devices such as extension surfaces or fins, which are important for passive natural convection, were not included.

SUMMARY OF THE INVENTION

This invention discloses heat dissipation devices for LED lamps with a plate-type heat spreader as the core unit. The plate-type heat spreader is either a flat-plate heat pipe or a metal plate embedded with heat pipes. The high-power LED lamps are thermally connected to the bottom surface of the heat spreader so that the heat generated by the LED lamps is absorbed by the evaporation region of the flat-plate heat pipe or the embedded heat pipes. The heat is spread by internal vapor motion of the working fluid toward different regions of the heat spreader. The top surface of the heat spreader is connected with a finned heat sink, where the heat is delivered to the ambient air. The hot air leaves by buoyancy through the openings on a lamp housing above the finned heat sink. An alternative design is that the inner surface of the lamp housing is connected with the top surface of the plate-type heat spreader, with the heat dissipated out at the surface of the housing by natural convection.

DETAILED DESCRIPTION OF THE INVENTION

Figure 1A:
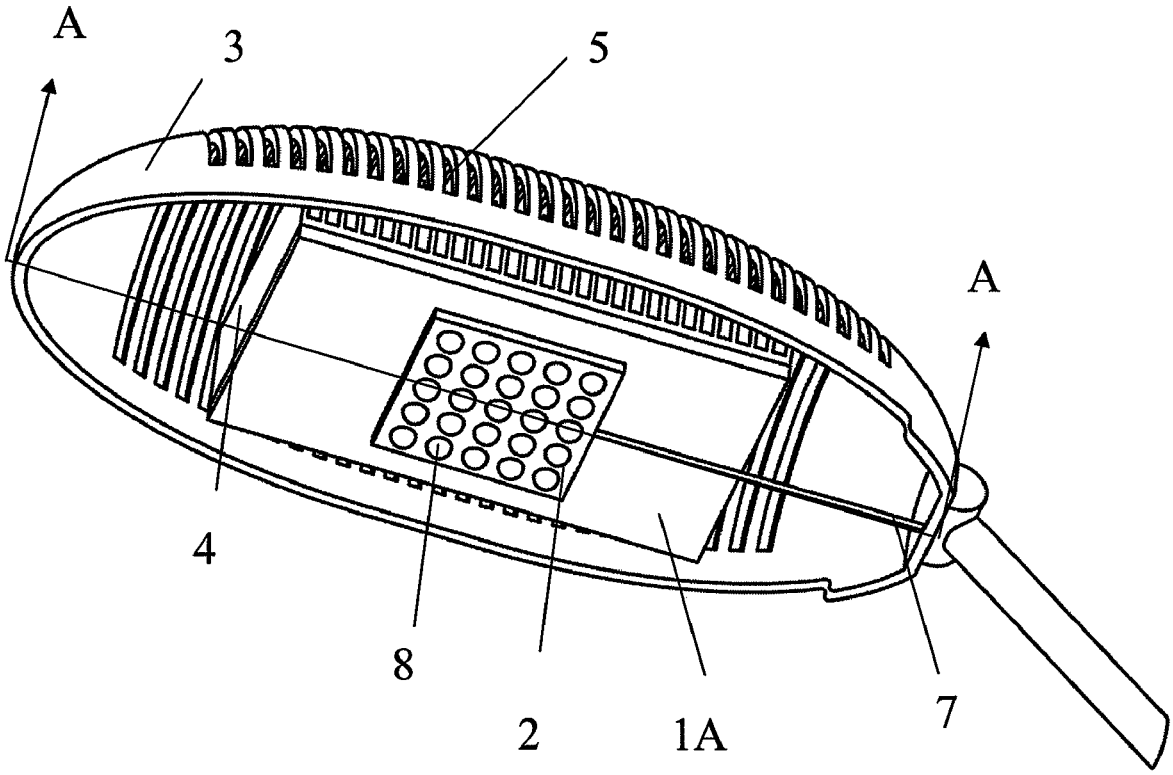
FIG. 1*a* is the perspective view of a first embodiment according to the present invention.
Figure 1B:
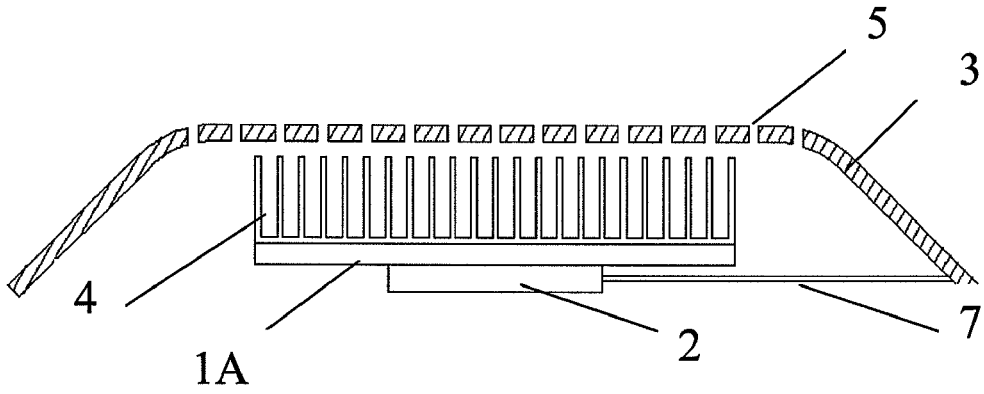
FIG. 1*b* is the cross-sectional view of the A-A section shown in FIG. 1*a*.
Figure 2A:
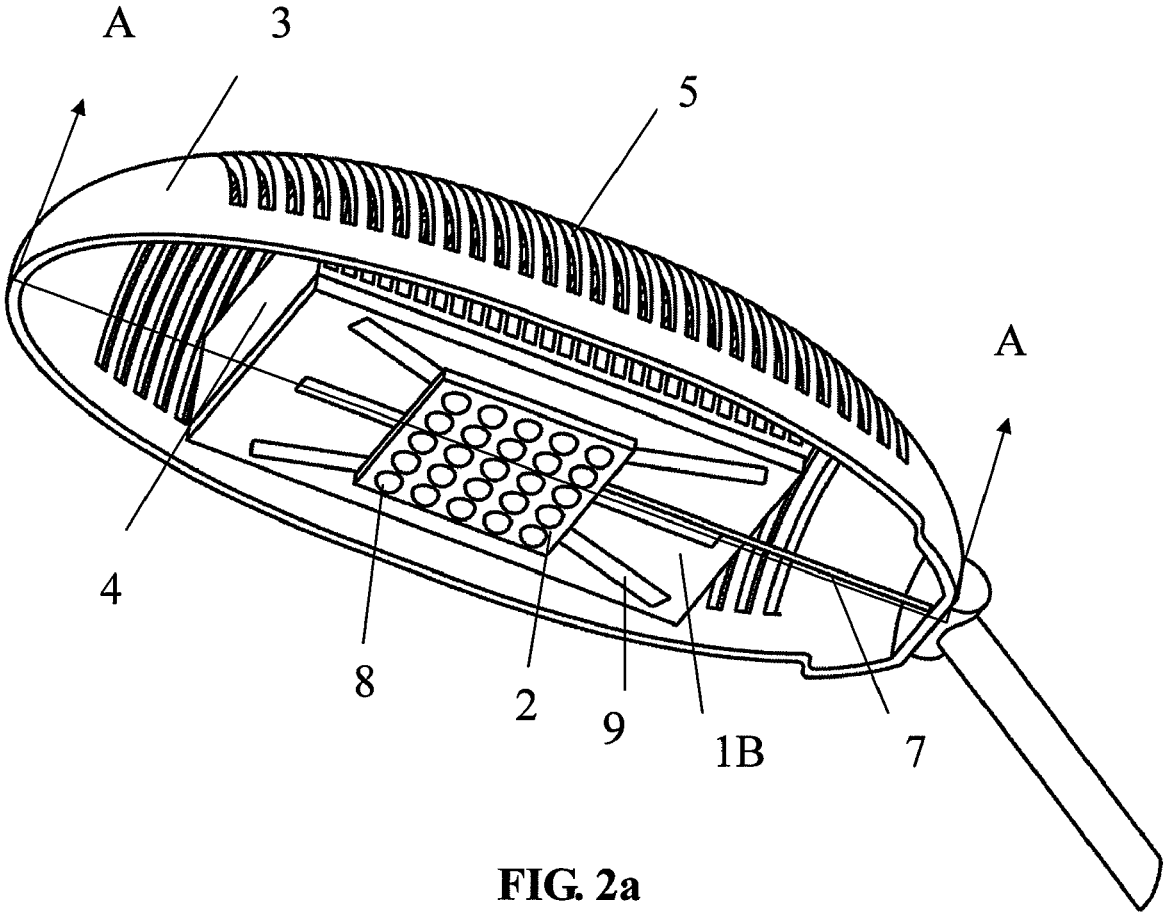
FIG. 2*a* is the perspective view of a second embodiment according to the present invention.
Figure 2B:
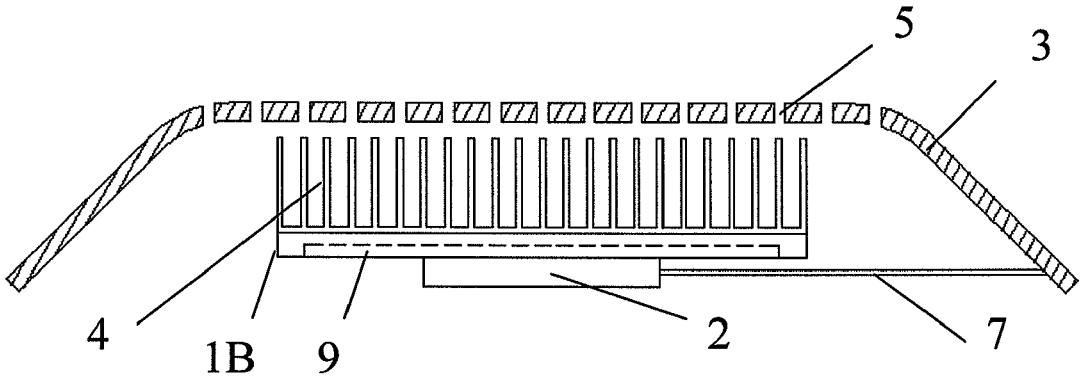
FIG. 2*b* is the cross-sectional view of the A-A section shown in FIG. 2*a*.

FIG. 1*a* shows a first embodiment in which a flat-plate heat pipe 1A is adopted as the plate-type heat spreader. The lamps are exemplified as a lamp set 2 in this embodiment. Each lamp comprises at least one LED chip mounted on a base substrate. FIG. 1*a* is the perspective view and FIG. 1*b* is the cross-sectional view of the A-A section of the device as shown in FIG. 1*a*. FIG. 2*a* shows a second embodiment in which a heat-pipe-embedded plate-type heat spreader 1B is adopted as the plate-type heat spreader. FIG. 2*a* is the perspective view and FIG. 2*b* is the cross-sectional view of the A-A section of the device as shown in FIG. 2*a*. In FIG. 2*b*, the heat pipes 9 are shown in phantom by dotted lines. Each LED lamp 8 in the LED lamp set 2, powered by the electric wire 7, produces light and heat. To keep the LED chips (not shown) in the LED lamp 8 at low temperature, the base (i.e., the major heat dissipation route) of the LED lamp set 2 is thermally connected to the bottom surface of the flat-plate heat pipe 1A (FIG. 1*a*) or the heat-pipe-embedded plate-type heat spreader 1B (FIG. 2*a*). The heat produced by the LED lamp set 2 is spread through the flat-plate heat pipe 1A or the heat-pipe-embedded plate-type heat spreader 1B to the fins 4, where the heat is delivered to the ambient air by natural convection. The heated air flows upward, driven by buoyancy, out of the lamp through the openings 5 in the lamp housing 3 above the fins 4. The interface between the base of the LED lamp set 2 and the flat-plate heat pipe 1A (or the heat-pipe-embedded plate-type heat spreader 1B) should be electrically insulating to avoid electricity leakage. This can be done by applying a thin layer of thermally conductive but electrically insulating material at the interface (not shown).

Figure 3A:
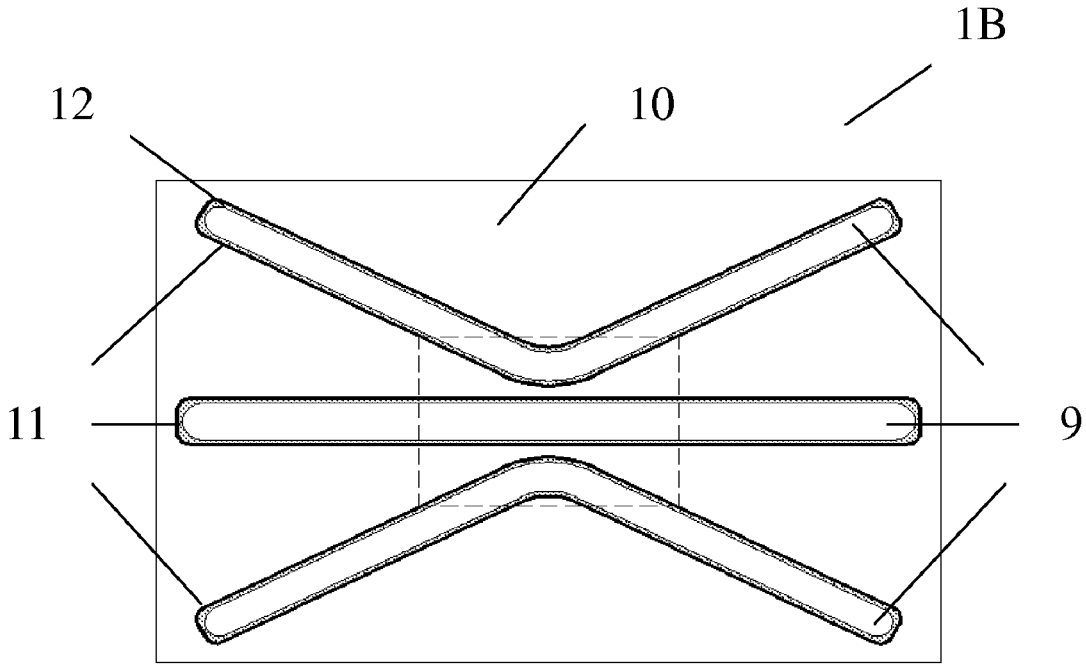
FIG. 3*a* shows the bottom view of the heat-pipe-embedded plate-type heat spreader used in FIGS. 2*a*-2*b*.
Figure 3B:
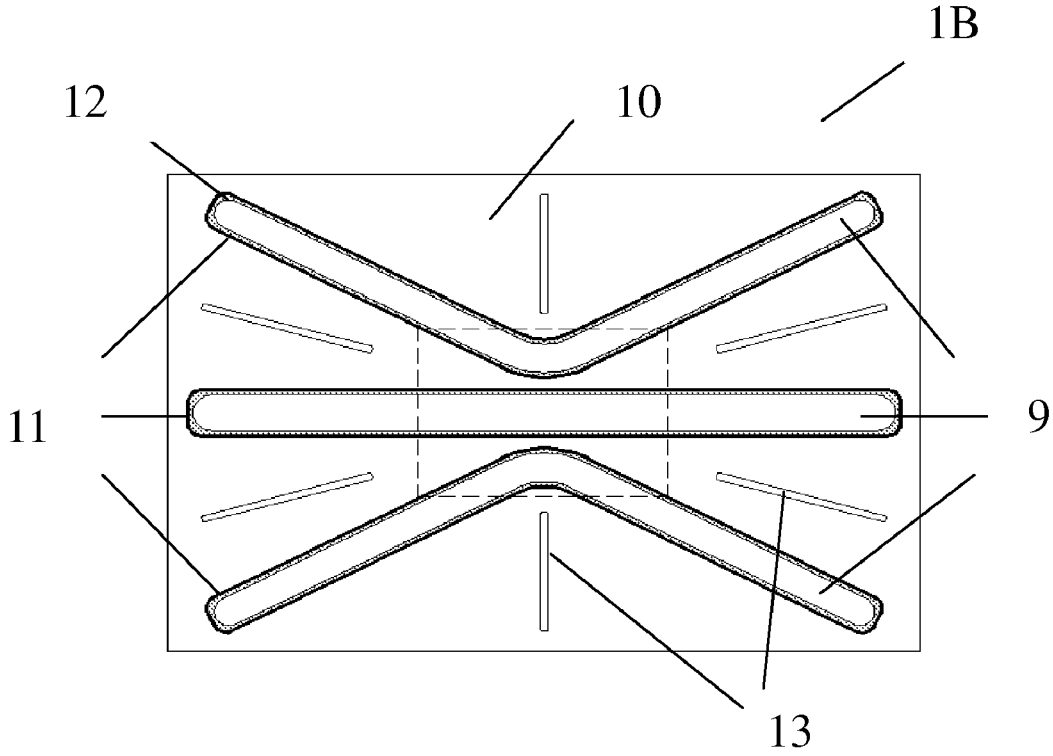
In FIG. 3*b*, a plurality of through holes are made on the metal plate as additional passages for air flow.

FIG. 3*a* shows the bottom view of the heat-pipe-embedded plate-type heat spreader 1B. It consists of a metal plate 10 and a plurality of heat pipes 9 embedded in the metal plate 10. In FIG. 3*b*, a plurality of through holes 13 are further made on the metal plate 10, as well as on the base plate of the fins 4 to form through passages. These through holes 13 facilitate natural convection by allowing air flow from below the metal plate 10. The material of the metal plate 10 is preferably high-conductivity copper, copper alloys, aluminum, or aluminum alloys. The heat pipes 9 are placed in the ditches 11 made on the surface of the metal plate 10. The gap between the heat pipes 9 and the walls of the ditches 11 can be filled with thermally conductive materials 12, such as thermal epoxy or thermal silicone. The heat pipes 9 can also be bonded in the ditches 11 by soldering.

The region for connection between the LED lamp set 2 and the bottom surface of the flat-plate heat pipe 1A (or the heat-pipe-embedded plate-type heat spreader 1B) is arranged at the place where the working fluid within the flat-plate heat pipe 1A or the heat pipes 9 in the plate-type heat spreader 1B can evaporate efficiently. The heat from the LED lamp set 2 is absorbed by the phase change process of the working fluid within the heat pipes and spread out via internal vapor motion. For the case with the flat-plate heat pipe 1A, the region of connection corresponds to its evaporation zone. For the case with the heat-pipe-embedded plate-type heat spreader 1B as shown in FIG. 3*a*, the connection region is where heat pipes 9 are concentrated, as enclosed by the broken lines. The parts of the enclosed region without heat pipes can be arranged with holes for screws (not shown) to fix the LED lamp set 2 onto the plate-type heat spreader 1B. The fins 4 are arranged on the upper surface of the flat-plate heat pipe 1A or the heat-pipe-embedded plate-type heat spreader 1B to function as part of the heat sink. The vapor within the flat-plate heat pipe 1A or the heat pipes 9 in the plate-type heat spreader 1B condenses at the low-temperature top region adjacent to the base plate of the fins 4. The heat released by vapor condensation in the pipe is conducted to the fins 4 and subsequently delivered away by the air flow.

The shape of the flat-plate heat pipe 1A or the heat-pipe-embedded plate-type heat spreader 1B is not limited to rectangle as in the figures. The fins 4 can be plate fins or pin fins (e.g., straight pin fins or conical pin fins) of various cross-section (such as rectangular, rhomboid, quadrilateral, multilateral, or circular, etc.). The set of fins 4 and the flat-plate heat pipe 1A (or the heat-pipe-embedded plate-type heat spreader 1B) can be fabricated separately and then connected together. To reduce the contact resistance, a layer of thermally conductive material, such as thermal epoxy or thermal silicone, can be applied at the interface. Alternatively, the base plate of fins 4 and the flat-plate heat pipe 1A (or the heat-pipe-embedded plate-type heat spreader 1B) can be soldered together. For the case with heat-pipe-embedded plate-type heat spreader 1B, the fins 4 and the metal plate 10 can be fabricated as a single unit. The number of heat pipes 9 in the plate-type heat spreader 1B as well as the pattern of the ditches 11 can vary as needed. For the first and second embodiments, active fans (not shown) can be put on the fins 4 or the lamp housing 3 to enhance cooling.

Figure 4A:
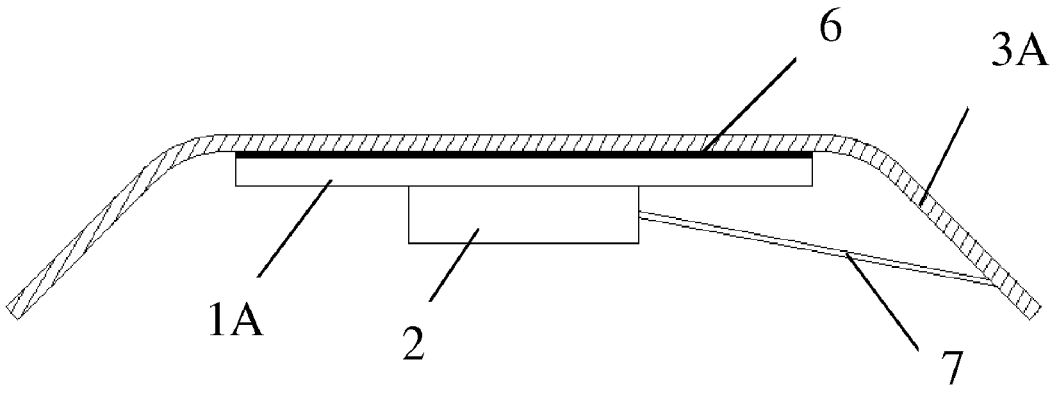
FIG. 4*a* shows a third embodiment adopting a flat-plate heat pipe.
Figure 4B:
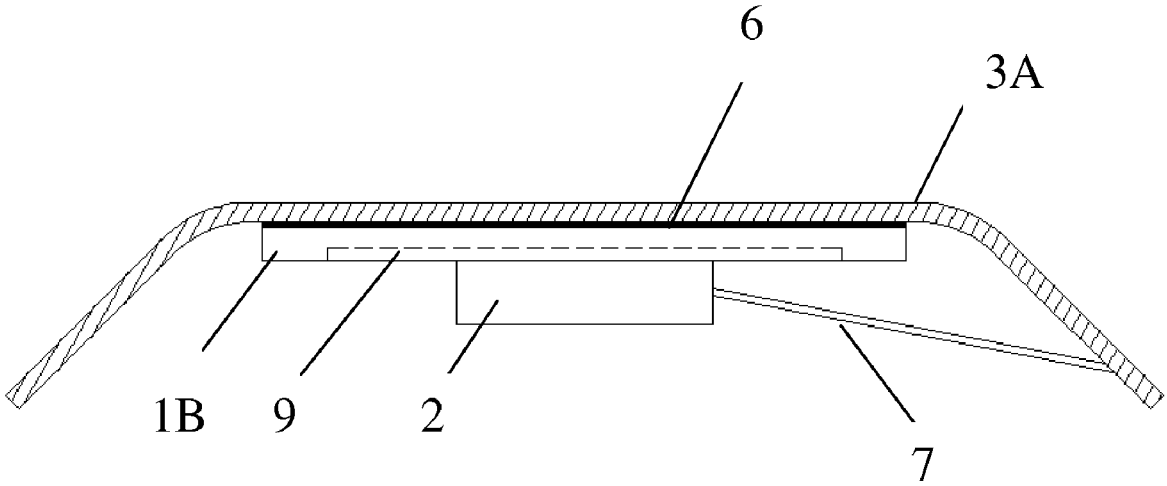
FIG. 4*b* shows a fourth embodiment adopting a heat-pipe-embedded plate-type heat spreader.

FIGS. 4*a* and *b* show cross-sectional views of third and fourth embodiments. FIG. 4*a* and FIG. 4*b* respectively show the situation when the flat-plate heat pipe 1A or the heat-pipe-embedded plate-type heat spreader 1B is adopted. In these embodiments, the flat-plate heat pipe 1A or the heat-pipe-embedded plate-type heat spreader 1B is directly connected to the inner surface of the lamp housing 3A made of high-conductivity materials. The lamp housing 3A provides extension surfaces to the flat-plate heat pipe 1A or the heat-pipe-embedded plate-type heat spreader 1B for convection enhancement. The material of the lamp housing 3A can be copper, copper alloys, aluminum, or aluminum alloys. To reduce the contact resistance between the flat-plate heat pipe 1A (or the heat-pipe-embedded plate-type heat spreader 1B) and the lamp housing 3A, a layer of thermally conductive material 6, such as thermal epoxy or thermal silicone, can be applied at the interface. Or, the lamp housing 3A and the flat-plate heat pipe 1A (or the heat-pipe-embedded plate-type heat spreader 1B) can be soldered together. Also, they can be screwed together. For the case with heat-pipe-embedded plate-type heat spreader 1B, the lamp housing 3A and the metal plate 10 can be fabricated as a single unit. Again, a plurality of holes 13 as shown in FIG. 3*b* can be further made through the metal plate 10 and lamp housing 3A to facilitate natural convection.

Figure 5A:
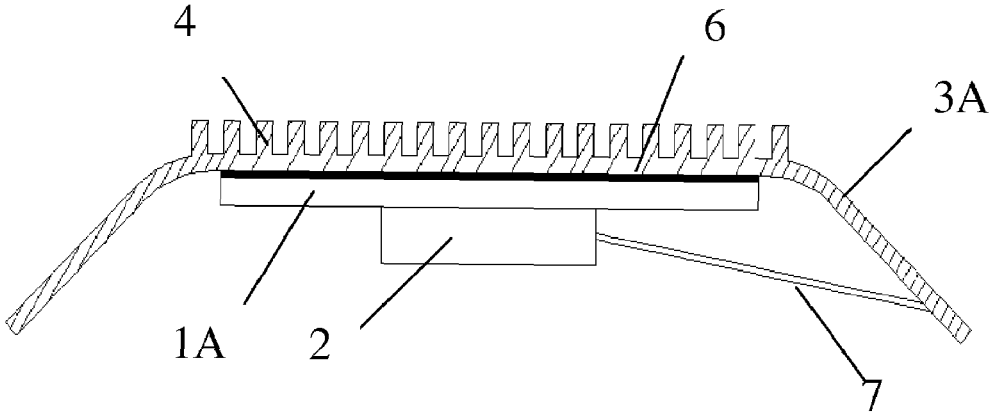
FIG. 5*a* shows a fifth embodiment adopting a flat-plate heat pipe.
Figure 5B:
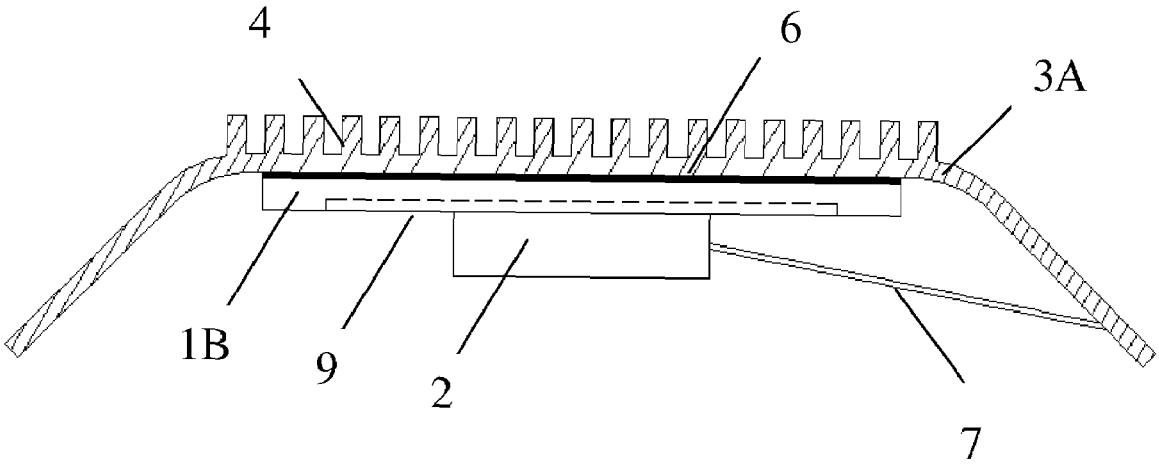
FIG. 5*b* shows a sixth embodiment adopting a heat-pipe-embedded plate-type heat spreader.
Figure 6:
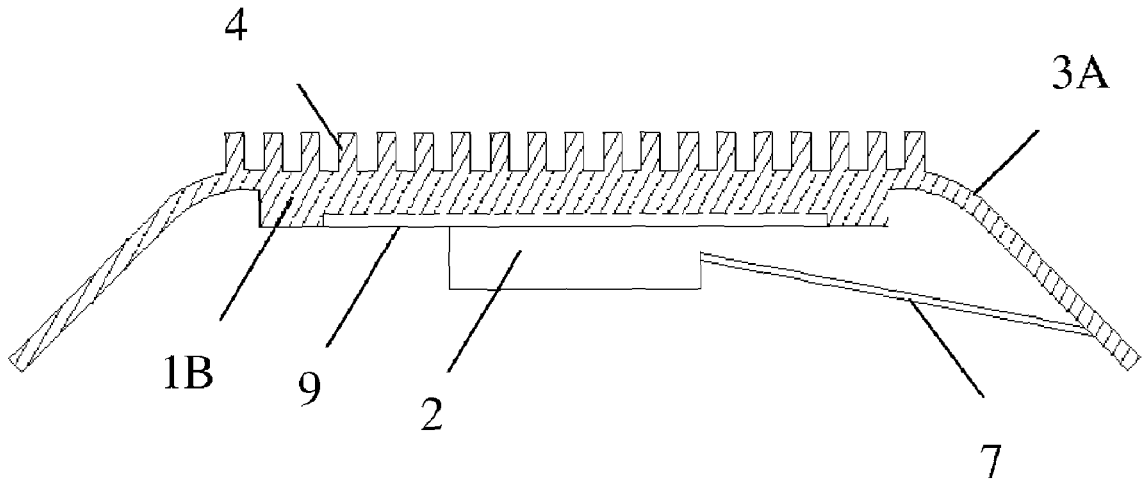
FIG. 6 shows the cross-sectional view of a seventh embodiment according to the present invention.

FIGS. 5*a* and *b* show fifth and sixth embodiments in which the outer surface of the lamp housing 3A contains fins 4 to increase the extension surface for convection. FIG. 5*a* and FIG. 5*b* respectively show the situation when the flat-plate heat pipe 1A or the heat-pipe-embedded plate-type heat spreader 1B is adopted. The fins 4 can be plate fins or pin fins (e.g., straight pin fins or conical pin fins) of various cross-section (such as rectangular, rhomboid, quadrilateral, multilateral, or circular, etc.). FIG. 6 shows a seventh embodiment in which the lamp housing 3A, the fins 4, and the metal plate 10 of the heat-pipe-embedded plate-type heat spreader 1B are made as a single unit.

In embodiments three to seven (without the holes 13 through the metal plate 10 and lamp housing 3A), the bottom side of the lamp housing 3 can be enclosed within a transparent cover (not shown) to make the lamp housing 3A watertight.

While the preferred embodiments of the invention have been described, it will be apparent to those skilled in the art that various modifications may be made without departing from the spirit of the present invention. Such modifications are all within the scope of this invention.

The invention claimed is:

1. A heat dissipation device for an LED lamp set, comprising:

a metal plate having a top surface and a bottom surface;

at least one ditch in said bottom surface;

at least one heat pipe being embedded inside said ditch, said heat pipe having working fluid inside for absorbing heat from said LED lamp set through phase change of the working fluid;

a lamp housing, having an inner surface directly contacting with the top surface of said metal plate for heat dissipation; and a plurality of fins located on an outer surface of said lamp housing.

2. The device as described in claim 1, wherein said fins are selected from the group consisting of plate fin, straight pin fin, and conical pin fin.

3. The device as described in claim 1, wherein said metal plate and said lamp housing comprise a plurality of through openings configured as additional passages for air flow.

4. The device as described in claim 1, wherein said lamp housing and said metal plate are configured as a single unit.

5. The device as described in claim 1, further comprising: thermal conductive material, filled in a gap between the heat pipe and the ditch.

* * * * *